US008160263B2

(12) United States Patent
Apsey et al.

(10) Patent No.: US 8,160,263 B2
(45) Date of Patent: Apr. 17, 2012

(54) NOISE REDUCTION BY MOBILE COMMUNICATION DEVICES IN NON-CALL SITUATIONS

(75) Inventors: Richard Apsey, Lower Early (GB); David J. Bennetts, Munich (DE); Nic A. Redshaw, Hurst (GB)

(73) Assignee: Agere Systems Inc., Allentown, PA (US)

( * ) Notice: Subject to any disclaimer, the term of this patent is extended or adjusted under 35 U.S.C. 154(b) by 681 days.

(21) Appl. No.: 12/298,620

(22) PCT Filed: May 31, 2006

(86) PCT No.: PCT/US2006/020724

§ 371 (c)(1),
(2), (4) Date: Oct. 27, 2008

(87) PCT Pub. No.: WO2007/139543

PCT Pub. Date: Dec. 6, 2007

(65) Prior Publication Data

US 2009/0310795 A1 Dec. 17, 2009

(51) Int. Cl.
*G10K 11/16* (2006.01)

(52) U.S. Cl. ..... 381/71.1; 379/392.01; 455/556.1

(58) Field of Classification Search ..... 381/71.1; 379/392.01; 455/556.1

See application file for complete search history.

(56) References Cited

U.S. PATENT DOCUMENTS 5,239,578 A * 8/1993 Regen et al. ..... 379/392.01
5,978,689 A * 11/1999 Tuoriniemi et al. ..... 455/569.1
6,001,131 A * 12/1999 Raman ..... 704/226
6,606,506 B1 * 8/2003 Jones ..... 455/556.1
6,978,010 B1 * 12/2005 Short et al. ..... 379/388.03
7,123,936 B1 * 10/2006 Rydbeck et al. ..... 455/557
7,206,418 B2 * 4/2007 Yang et al. ..... 381/92

(Continued)

FOREIGN PATENT DOCUMENTS

GB 2 308 775 A 7/1997

(Continued)

OTHER PUBLICATIONS

Office Action; Mailed Apr. 11, 2011 for the corresponding Japanese Application No. 2009-513107 filed on Nov. 28, 2008.

(Continued)

*Primary Examiner* — Elvin G Enad
*Assistant Examiner* — Robert W Horn
(74) *Attorney, Agent, or Firm* — Mendelsohn, Drucker & Associates, P.C.; Edward J. Meisarosh; Steve Mendelsohn

(57) ABSTRACT

In a preferred embodiment, the invention is a mobile communication device having a digital signal processor (DSP), a speaker output node, a local audio source, and an analog front-end (AFE), wherein: (1) the DSP receives a first audio signal corresponding to sound captured by a microphone near a user of the device, (2) if the device is operating in a call mode, the DSP derives a background noise signal from the first audio signal, for subtraction from the first audio signal before transmission to the AFE, and (3) if the device is operating in a non-call mode, then the DSP (i) generates a speaker output signal which substantially corresponds to the first audio signal subtracted from a local audio signal provided by the local audio source and (ii) provides the speaker output signal to a speaker via the speaker output node.

22 Claims, 3 Drawing Sheets

U.S. PATENT DOCUMENTS

| | | | | |
|---|---|---|---|---|
| 7,225,001 | B1 * | 5/2007 | Eriksson et al. | 455/570 |
| 7,499,686 | B2 * | 3/2009 | Sinclair et al. | 455/223 |
| 7,627,352 | B2 * | 12/2009 | Gauger et al. | 455/569.1 |
| 7,764,980 | B2 * | 7/2010 | Yoo | 455/570 |
| 2001/0041590 | A1 * | 11/2001 | Silberfenig et al. | 455/556 |
| 2002/0193130 | A1 * | 12/2002 | Yang et al. | 455/501 |
| 2004/0059571 | A1 * | 3/2004 | Ohtomo | 704/226 |
| 2004/0076288 | A1 * | 4/2004 | Cairns | 379/406.05 |
| 2004/0142672 | A1 | 7/2004 | Stankewitz | |
| 2005/0064826 | A1 * | 3/2005 | Bennetts et al. | 455/114.3 |
| 2005/0090295 | A1 * | 4/2005 | Ali et al. | 455/575.2 |
| 2006/0013410 | A1 * | 1/2006 | Wurtz | 381/74 |
| 2006/0270467 | A1 * | 11/2006 | Song et al. | 455/570 |
| 2007/0041582 | A1 * | 2/2007 | Lam | 379/908 |
| 2007/0082612 | A1 * | 4/2007 | Valve et al. | 455/41.2 |
| 2007/0225035 | A1 * | 9/2007 | Gauger et al. | 455/553.1 |
| 2007/0263847 | A1 * | 11/2007 | Konchitsky | 379/392.01 |
| 2009/0310795 | A1 * | 12/2009 | Apsey et al. | 381/71.1 |
| 2011/0130176 | A1 * | 6/2011 | Magrath et al. | 455/570 |

FOREIGN PATENT DOCUMENTS

| | | | |
|---|---|---|---|
| GB | 2308775 | A | 7/1997 |
| JP | 09-187060 | A | 7/1997 |
| JP | 10-210131 | A | 8/1998 |
| JP | 11-041341 | A | 2/1999 |
| JP | 2006-129377 | A | 5/2006 |
| WO | 9326085 | A | 12/1993 |

OTHER PUBLICATIONS

Machine-generated English translation of Description of JP 2006 129377 (Reference 1 from Japanese Office Action).

Machine-generated English translation of Description of JP 11 041341 (Reference 2 from Japanese Office Action).

Machine-generated English translation of Description of JP 10 210131 (Reference 3 from Japanese Office Action).

* cited by examiner

NOISE REDUCTION BY MOBILE COMMUNICATION DEVICES IN NON-CALL SITUATIONS

BACKGROUND OF THE INVENTION

1. Field of the Invention

The present invention relates in general to mobile communication devices, and in particular to the reduction of noise heard by a user of a mobile communication device.

2. Description of the Related Art

An important function of a mobile communication device is to adequately transmit human voice over a wireless network. One method to improve the transmission of voice using a mobile communication device is to filter the signal to reduce the background noise that is transmitted by the mobile communication device along with a user's voice. Some techniques for reducing background noise rely on known differences in the characteristics, such as the frequency spectrum, between human voice and typical background noise. Some techniques rely on measured differences between audio samples at different locations, such as nearer to and farther from the user's mouth. Noise suppression techniques are used alongside other methods, such as echo canceling, to improve the transmission of voice using a mobile communication device.

Noise filtering, as well as other signal processing tasks, such as signal encoding and decoding, are typically performed by one or more digital signal processors (DSPs) in the mobile communication device. A DSP can be implemented in various ways, such as an application-specific integrated circuit (ASIC), a portion of an ASIC, a programmable circuit, software code, or a combination including any of the above.

SUMMARY OF THE INVENTION

In one embodiment, the present invention is a mobile communication device comprising a digital signal processor (DSP), a microphone input node, a speaker output node, an analog front-end, and an antenna, wherein the mobile communication device is adapted to operate in a call mode and a non-call mode. The microphone input node is adapted to receive a first audio signal corresponding to sound captured by a microphone connected to the microphone input node and located near a user of the mobile communication device. If the mobile communication device is operating in the call mode, then (a) the DSP (i) derives a background noise signal from the first audio signal, wherein the background noise signal substantially characterizes background noise near the user, (ii) generates a second audio signal substantially equivalent to the sum of the first audio signal and an inverse of the background noise signal, and (iii) provides the second audio signal to the analog front-end; (b) the analog front-end receives the second audio signal and generates a corresponding first radio-frequency signal for transmission by the antenna to a wireless network; (c) the antenna receives from the wireless network a second radio-frequency signal for transmission to the analog front-end, which generates a corresponding received audio signal; and (d) the DSP provides to a speaker via the speaker output node a speaker output signal based on the received audio signal. If the mobile communication device is operating in the non-call mode, then the DSP (i) generates a speaker output signal based on at least the first audio signal, and (ii) provides the speaker output signal to a speaker via the speaker output node.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

DETAILED DESCRIPTION

Mobile communication devices were developed to provide enhanced telephone call capabilities, and as such, one goal was the efficient transmittal of human voice from the talker to the listener, wherein part of the transmittal path is wireless. One category of techniques to better transmit the voices of the users includes the suppression in the transmitted signal of background noises that are not the talker's voice. One such technique involves sampling the background sounds around the phone using a microphone sufficiently isolated from the talker's sound, and using digital processing to reduce the background sounds relative to the talker's voice before transmittal to the listener. A simple version of this technique involves subtracting the background sound signal from (which is equivalent to adding an inverse of the background sound signal to) the captured combined signal, which contains the talker's voice with the background signal.

Figure 1:
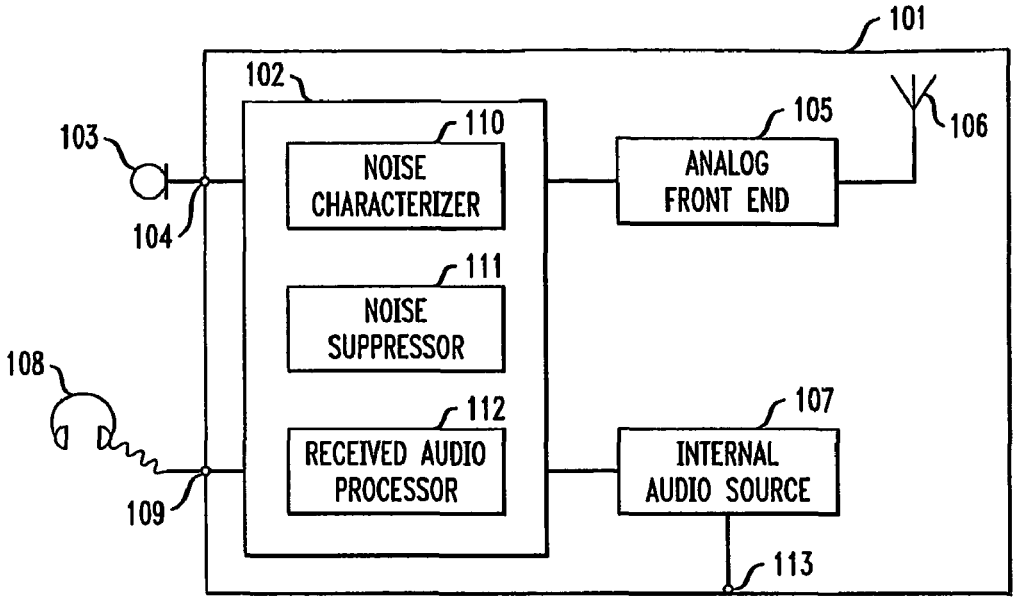
FIG. 1 is a simplified block diagram of a mobile communication device in accordance with one embodiment of the present invention.

FIG. 1 shows a simplified block diagram of a mobile communication device in accordance with one embodiment of the present invention. Mobile communication device 101 comprises DSP 102, analog front-end 105, internal audio source 107, antenna 106, microphone input node 104, speaker output node 109, and optional external audio source jack 113. DSP 102 comprises noise characterizer 110, noise suppressor 111, received audio processor 112, and possibly other circuitry (not shown) for encoding and decoding communication signals sent to and received from analog front-end 105. Analog front-end 105 provides a communication and translation link between antenna 106 and DSP 102. Optional external audio source jack 113 allows the connection of external local audio devices (e.g., MP3 players) to mobile communication device 101. Microphone input node 104 connects microphone 103 to DSP 102. Speaker output node 109 connects speaker 108 to DSP 102. Microphone 103 and speaker 108 may be configured together in the form of an external stereo headphone and microphone set (not shown).

Figure 2:
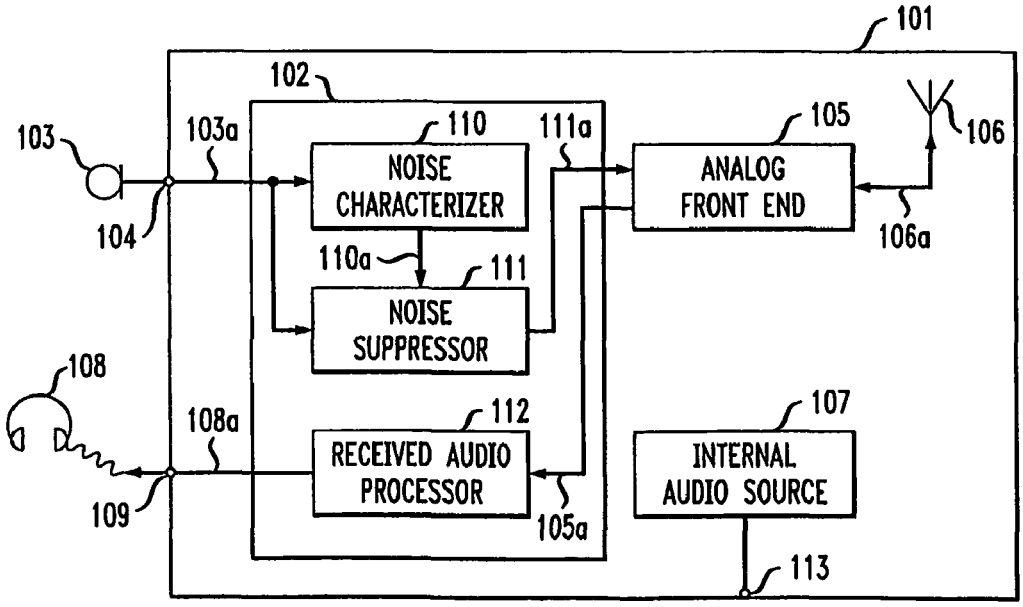
FIG. 2 is a simplified block diagram illustrating operation of the mobile communication device of FIG. 1 if the device is connected on a call.

FIG. 2 is a simplified block diagram illustrating the operation of mobile communication device 101 if mobile communication device 101 is connected on a call. The user's voice and any background noise are captured by microphone 103, which converts the sound energy it picks up into electrical audio signal 103*a*. Audio signal 103*a* may be analog or digital. Audio signal 103*a* is provided via microphone input node 104 to DSP 102, which optionally includes an A/D converter (not shown) to convert audio signal 103*a* into a digital signal if it has not already been converted to the digital domain. The digital version of audio signal 103*a* is provided to both noise characterizer 110 and noise suppressor 111.

Noise characterizer 110 derives the background noise from audio signal 103*a* picked up by microphone 103 and generates background noise signal 110*a*, which substantially characterizes the background noise. Noise characterizer 110 generates background noise signal 110*a* by one or more methods, such as sampling the sounds picked up by microphone 103 during periods the user is not talking, derivation based on known characteristics of human voice and/or background noise, or using a second microphone (not shown), which is sufficiently isolated from the user's voice, to provide a background noise signal.

Noise suppressor 111 receives background noise signal 110*a*, subtracts background noise signal 110*a* from audio signal 103*a* (e.g., by inverting background noise signal 110*a* and adding the inverted signal to audio signal 103*a*), and generates noise-suppressed audio signal 111*a*. Noise-suppressed audio signal 111*a* is provided to analog front-end 105.

Analog front-end 105 acts as an intermediary between DSP 102 and antenna 106, which transmits a signal corresponding to noise-suppressed audio signal 111*a* to the wireless network (not shown) that connects the user to the listener (not shown). Analog front-end 105 comprises an analog audio block (not shown) for converting audio signals between the digital and analog domains. Analog front-end 105 also comprises an analog radio block (not shown) for transforming an audio signal to and from a corresponding radio frequency signal that is transmitted via antenna 106. The term radio frequency as used herein refers generally to any frequency suitable for wireless transmission from the mobile communication device to a wireless network. Analog front-end 105 is connected to antenna 106 via path 106*a*. If analog front-end 105 receives an incoming radio frequency signal from antenna 106 that corresponds to an audio signal, analog front-end 105 transforms the incoming radio frequency signal into digital received audio signal 105*a*, which it provides to received audio processor 112, which is located in DSP 102.

Received audio processor 112 processes signal 105*a* to enhance or control the signal through means known in the art, such as volume control. Received audio processor 112 may also rely on known spectral characteristics of voices and/or noise to suppress noise in signal 105*a*. Received audio processor 112 provides speaker output signal 108*a* via speaker output node 109 to speaker 108, which converts the audio signal into an audible sound signal. Speaker output signal 108*a* may be converted from digital to analog by DSP 102 or by a D/A converter (not shown) external to DSP 102.

Noise characterizer 110, noise suppressor 111, received audio processor 112, and one or more optional A/D and D/A converters (not shown) can share one or more physical components of DSP 102 if DSP 102 is implemented as hardware. These blocks are labeled and described separately here to facilitate description of their functions and not necessarily to define their physical structure. Speaker 108 can be in the form of headphones, an earpiece, an external speaker, or any suitable conveyor of audio information to a user.

Increasingly, mobile communication devices are providing audio features in addition to their person-to-person vocal communication service. Examples of such audio features, usually utilized when the user is not engaged in a telephone conversation, include the ability to listen to the audio signals of videos, music, and spoken recordings (e.g., podcasts). These audio signals can be received from a source local to the mobile communication device. The local audio source can be an internal audio source, or the local audio source can be an external audio source, connected to the mobile communication device by wire, or even wirelessly (e.g., by using Bluetooth® technology). If the local audio source is an external device, then local audio source 107 can function as simple pass-through, or can process the signal from the external device to adjust volume, balance, equalization, etc. If a user is listening to audio from a local audio source, as opposed to being on a call, then the mobile communication device, and particularly the DSP, are not likely to be as engaged in processing a communication signal to or from a wireless communication network. Therefore, in non-call situations, components and processing power may be more readily available for noise filtering, including for the reduction of perceived background noise in the vicinity of the user.

Figure 3:
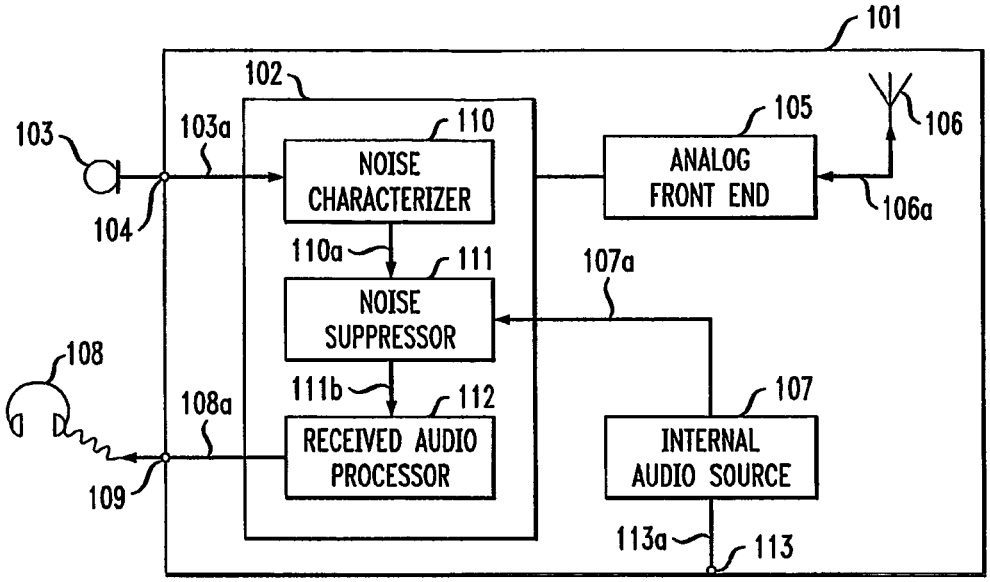
FIG. 3 is a simplified block diagram illustrating operation of the mobile communication device of FIG. 1 if the device is not connected on a call.

FIG. 3 is a simplified block diagram illustrating operation of mobile communication device 101 if the device is not connected on a call and is providing an audio signal from internal audio source 107, wherein mobile communication device 101 is used to reduce the background noise heard by the user.

In a non-call situation, as depicted in FIG. 3, mobile communication device 101 is not engaged in a telephone call, but is ready to make and receive calls, and to send and receive standby maintenance information (e.g., time, network status, telephone status, etc.), or relatively brief messages (e.g., text messages, instant messages, etc.). The DSP may be used to periodically process a communication signal via analog front-end 105 as the mobile communication device monitors a paging channel to see if there are any calls coming in for it, and periodically monitors the serving and neighboring cells. Thus, in a non-call situation, analog front-end 105 can communicate with a wireless network via antenna 106, wherein analog front-end 105 and antenna 106 operate in an intermittent mode.

Optionally, mobile communication device 101 can be disconnected from any wireless network, wherein antenna 106 is not sending or receiving an information signal. Thus, in a disconnected situation, antenna 106 and analog front-end 105 are in an incommunicado mode, which can help reduce battery power consumption, and also allows use of non-call features of the mobile communication device without transmitting information via antenna 106 if transmittals from the device would be undesirable (e.g., when transmission would interfere with the normal operation of other devices nearby). Thus, in non-call situations, DSP 102 is not engaged in processing large amounts of data to and/or from analog front-end 105, and is more readily available for other uses, such as noise suppression when the user is listening to local audio signal 107*a*, which is received from internal audio source 107.

Internal audio source 107 can be non-volatile semiconductor memory, such as flash ROM, magnetic memory such as a hard disc drive, optical memory such as a miniature digital video disc, or any suitable audio source, which may, for example, be connected to internal audio source 107 via signal 113*a* by plugging an external audio source (not shown) into external audio source jack 113. The content provided by internal audio source 107 can be pre-recorded audio (e.g. mini-DVD, removable flash ROM device), downloaded and saved audio, recorded and saved audio (e.g., sound recorded using microphone 103), composed audio (e.g., tunes composed on communication device 101 using a keypad), or any other suitable audio. Internal audio source 107 provides audio signal 107*a* to noise suppressor 111, which is part of DSP 102. Processing parameters which may be preset or set by the user, such as volume control or equalization, may be applied to audio signal 107*a* before provision to noise suppressor 111.

Noise characterizer 110 receives audio signal 103*a*, which contains the background noise, from microphone 103 via microphone input node 104. Noise characterizer 110 may process audio signal 103*a* based on the signal's characteristics or optional user input (e.g. desired level of noise reduction). Noise characterizer 110 provides background noise signal 110*a* to noise suppressor 111. Noise suppressor 111 subtracts background noise signal 110*a* from local audio signal 107*a*, to generate noise-inverted audio signal 111*b*, which is provided to received audio processor 112.

Received audio processor 112 may process noise-inverted audio 111*b* in accordance with the signal's characteristics or optional user input (e.g., volume control). Received audio processor 112 provides to speaker 108, via speaker output node 109, speaker output signal 108*a*, which corresponds to noise-inverted audio signal 111*b*. Speaker 108 in turn converts electronic audio signal 108*a* into a sound signal that can be heard by the user. The user hears speaker output signal 108*a*, which substantially corresponds to the sum of local audio signal 107*a* and the inverse of audio signal 103*a*, as well as the background noise, which substantially corresponds to audio signal 103*a*. Thus the overall effect is that the background noise and its inverse substantially cancel each other out, and the user hears sound substantially equivalent to local audio signal 107*a*.

Speaker output signal 108*a* may be converted from digital form to analog form by a D/A converter (not shown) within DSP 102, or by a D/A converter (not shown) external to DSP 102. In a preferred embodiment, speaker 108 is in the form of stereo headphones worn by the user. In a preferred embodiment, microphone 103 is located on or proximate to headphones 108, such as on the side of the headset, where it can sample the background noise as close as possible to the user's ear (not illustrated). If two microphones are used, such as if each headphone has a microphone, then the signals from the microphones can be combined to provide average noise reduction to both ears, or each signal can be separately processed to provide separate noise reduction to each ear (not illustrated). In addition, if, for example, internal audio signal 107*a* is a stereo audio signal, then DSP 102 can process the left side audio and noise signals and the right side audio and noise signals separately, wherein each side's signals are processed as generally described elsewhere herein.

Noise suppressor 111 can also operate to provide quiet to the user without receiving local audio signal 107*a* from internal audio source 107, if, for example, internal audio source 107 is powered off or disconnected, or if it is not included in mobile communication device 101, or is otherwise unavailable. Noise suppressor 111 can generate noise-inverted audio signal 111*b* based on background noise signal 110*a*, which is in turn based on audio signal 103*a*, wherein noise-inverted audio signal 111*b* is used to reduce the amount of background noise heard by the user, thereby providing the user with relative quiet.

In an alternative embodiment (not shown), speaker output signal 108*a* is converted into a wireless signal (e.g., using Bluetooth® technology) for transmission to headphones 108 from speaker output node 109, which transmits speaker output signal 108*a* from received audio processor 112. Similarly, in an alternative embodiment (not shown), audio signal 103*a* is converted into a wireless signal (e.g., using Bluetooth® technology) for transmission from microphone 103 to microphone input node 104 for further transmission to noise characterizer 110.

In an alternative embodiment (not shown), speaker 108 and microphone 103 are together in the form of a mono-aural earpiece wherein microphone 103 is located along the wire that connects earpiece 108 to mobile communication device 101. In an alternative embodiment (not shown), microphone 103 is an integrated microphone of mobile communication device 101. In an alternative embodiment (not shown), speaker 108 is an integrated speaker of mobile communication device 101. In an alternative embodiment (not shown), mobile communication device 101 comprises more than one microphone, any of which can be used as microphone 103. In an alternative embodiment (not shown), mobile communication device comprises more than one speaker, any one or more of which can be used as speaker 108.

In an alternative implementation of the embodiment illustrated in FIG. 2, noise characterizer 110 inverts the background noise signal, and provides inverted background noise signal 110*a* to noise suppressor 111. Noise suppressor 111 adds inverted background noise signal 110*a* to audio signal 103*a* to generate noise-suppressed audio signal 111*a*. In an alternative implementation of the embodiment illustrated in FIG. 3, noise characterizer 110 inverts the background noise signal, and provides inverted background noise signal 110*a* to noise suppressor 111. Noise suppressor 111 adds inverted background noise signal 110*a* to local audio signal 107*a* to generate noise-inverted audio signal 111*b*.

Figure 4:
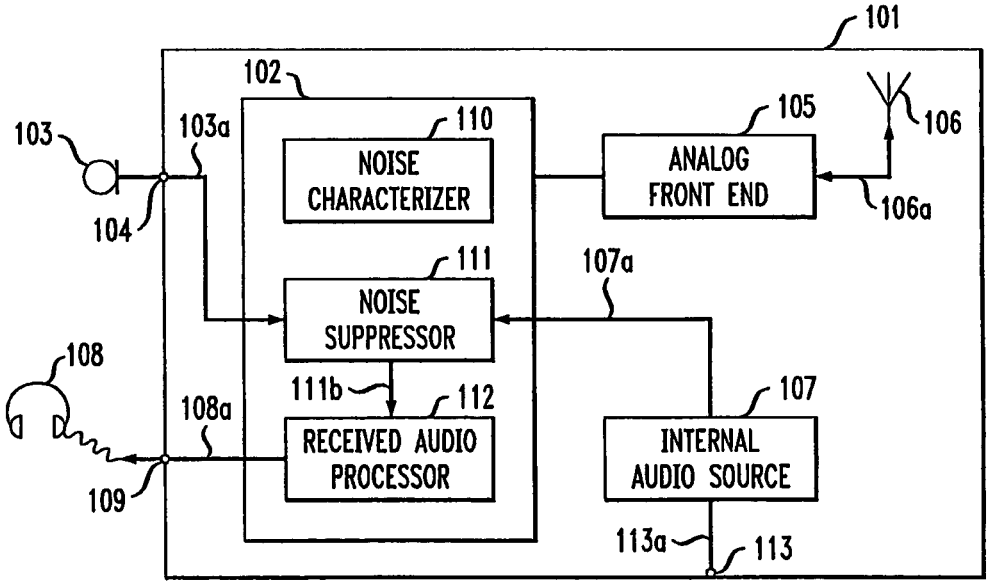
FIG. 4 is a simplified block diagram illustrating alternative operation of the mobile communication device of FIG. 1 if the device is not connected on a call, wherein the noise characterizer is bypassed.
Figure 5:
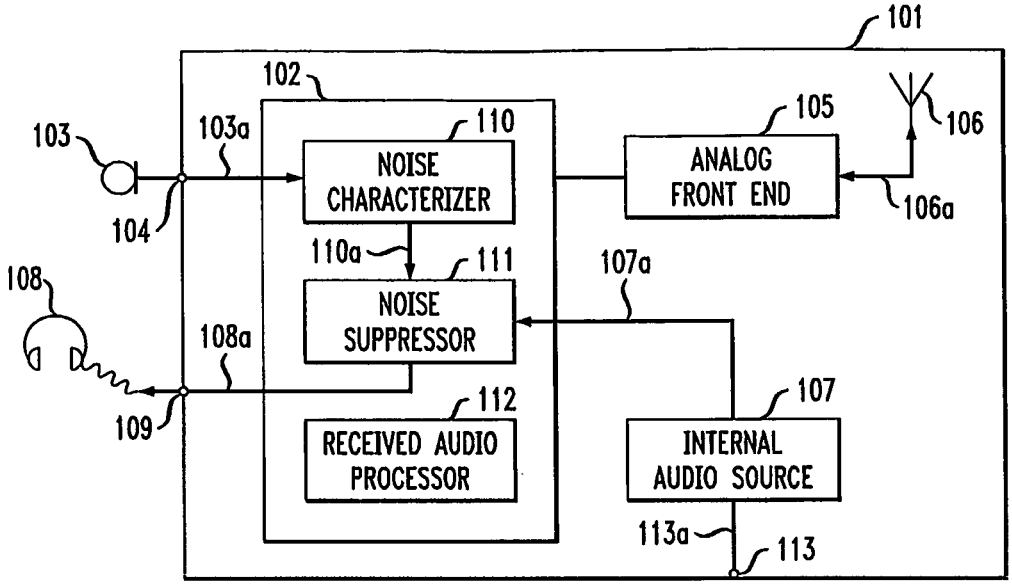
FIG. 5 is a simplified block diagram illustrating alternative operation of the mobile communication device of FIG. 1 if the device is not connected on a call, wherein the received audio processor is bypassed.
Figure 6:
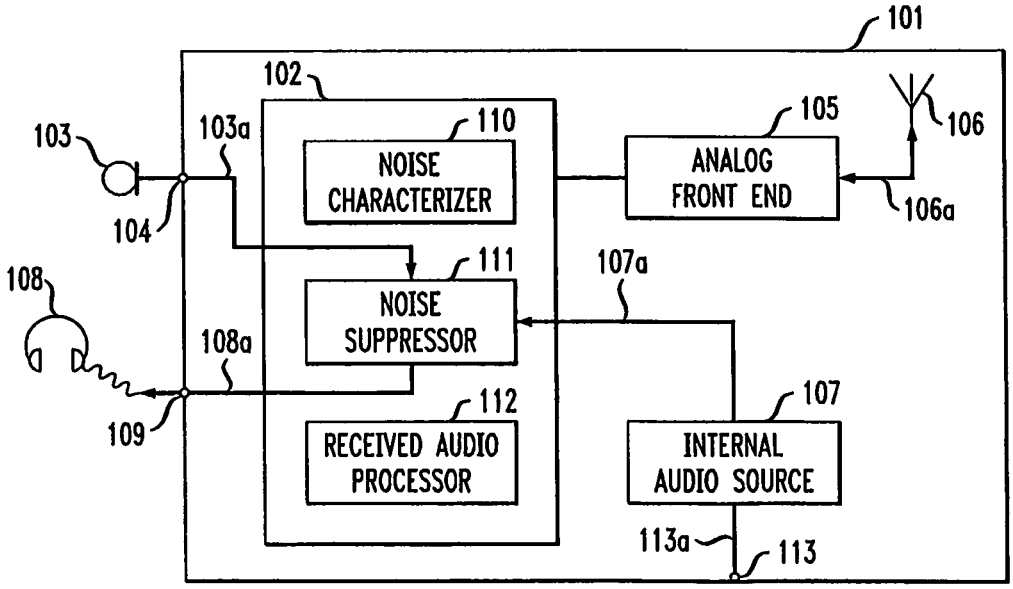
FIG. 6 is a simplified block diagram illustrating alternative operation of the mobile communication device of FIG. 1 if the device is not connected on a call, wherein the noise characterizer and the received audio processor are bypassed.

In an alternative implementation, illustrated in FIG. 4, audio signal 103*a* is provided directly to noise suppressor 111, bypassing noise characterizer 110. Noise suppressor 111 then subtracts audio signal 103*a* from local audio signal 107*a* to generate noise-inverted audio signal 111*b*. In an alternative implementation, illustrated in FIG. 5, noise suppressor 111 generates speaker output signal 108*a* and provides signal 108*a* to speaker 108, bypassing received audio processor 112. Speaker 108 converts speaker output signal 108*a* into a sound signal that can be heard by the user, wherein hearing includes hearing silence if, for example, local audio signal 107*a* is not provided to noise suppressor 111. In an alternative implementation, noise characterizer 110 inverts the background noise signal, and provides inverted background noise signal 110*a* to noise suppressor 111. Noise suppressor 111 adds inverted background noise signal 110*a* to local audio signal 107*a* to generate speaker output signal 108*a*. In an alternative implementation, illustrated in FIG. 6, audio signal 103*a* is provided to noise suppressor 111, bypassing noise characterizer 110, and noise suppressor 111 generates speaker output signal 108*a* for provision to speaker 108, bypassing received audio processor 112.

In an alternative embodiment, DSP 102 converts noise-suppressed audio signal 111*a* from digital to analog before transmission to analog front-end 105, which does not then perform a digital-to-analog conversion. In an alternative embodiment, DSP 102 converts received audio signal 105*a* from analog to digital, thus analog front-end 105 does not then perform an analog-to-digital conversion.

The present invention may be implemented as circuit-based processes, including possible implementation as a single integrated circuit (such as an ASIC or an FPGA), a multi-chip module, a single card, or a multi-card circuit pack. As would be apparent to one skilled in the art, various functions of circuit elements may also be implemented as processing steps in a software program. Such software may be employed in, for example, a digital signal processor, microcontroller, or general-purpose computer.

The present invention can be embodied in the form of methods and apparatuses for practicing those methods. The present invention can also be embodied in the form of program code embodied in tangible media, such as magnetic recording media, optical recording media, solid state memory, floppy diskettes, CD-ROMs, hard drives, or any other machine-readable storage medium, wherein, when the program code is loaded into and executed by a machine, such as a computer, the machine becomes an apparatus for practicing the invention. The present invention can also be embodied in the form of program code, for example, whether stored in a storage medium, loaded into and/or executed by a machine, or transmitted over some transmission medium or carrier, such as over electrical wiring or cabling, through fiber optics, or via electromagnetic radiation, wherein, when the program code is loaded into and executed by a machine, such as a computer, the machine becomes an apparatus for practicing the invention. When implemented on a general-purpose processor, the program code segments combine with the processor to provide a unique device that operates analogously to specific logic circuits.

Unless explicitly stated otherwise, each numerical value and range should be interpreted as being approximate as if the word "about" or "approximately" preceded the value of the value or range.

It will be further understood that various changes in the details, materials, and arrangements of the parts which have been described and illustrated in order to explain the nature of this invention may be made by those skilled in the art without departing from the scope of the invention as expressed in the following claims.

Although the steps in the following method claims, if any, are recited in a particular sequence with corresponding labeling, unless the claim recitations otherwise imply a particular sequence for implementing some or all of those steps, those steps are not necessarily intended to be limited to being implemented in that particular sequence.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures. Furthermore, the use of particular terms and phrases herein is for the purpose of facilitating the description of the embodiments presented and should not be regarded as limiting.

References in descriptions of alternative embodiments to particular figures or previously-described embodiments do not limit the alternatives to those particular shown or previously-described embodiments. Alternative embodiments described can generally be combined with any one or more of the other alternative embodiments shown or described.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

We claim:

1. A mobile communication device comprising a digital signal processor (DSP), a microphone input node, a speaker output node, an analog front-end, and an antenna, the mobile communication device adapted to operate in a call mode and a non-call mode, wherein:

the microphone input node is adapted to receive a first audio signal corresponding to sound captured by a microphone connected to the microphone input node and located near a user of the mobile communication device;

the DSP comprises a noise characterizer, a noise suppressor, and a received-audio processor;

if the mobile communication device is operating in the call mode, then:

(a) the DSP (i) derives a background noise signal from the first audio signal, wherein the background noise signal substantially characterizes background noise near the user, (ii) generates a second audio signal substantially equivalent to the sum of the first audio signal and an inverse of the background noise signal, and (iii) provides the second audio signal to the analog front-end;

(b) the analog front-end receives the second audio signal and generates a corresponding first radio-frequency signal for transmission by the antenna to a wireless network;

(c) the antenna receives from the wireless network a second radio-frequency signal for transmission to the analog front-end, which generates a corresponding received-audio signal;

(d) the DSP provides to a speaker via the speaker output node a speaker output signal based on the received-audio signal;

(e) the noise characterizer derives the background noise signal from the first audio signal;

(f) the noise suppressor generates the second audio signal using the background noise signal and the first audio signal; and (g) the received-audio processor processes the received-audio signal from the analog front-end and generates the speaker output signal based on the received-audio signal, for provision to the speaker via the speaker output node; and if the mobile communication device is operating in the non-call mode, then:

(a) the DSP (i) generates a speaker output signal based on at least the first audio signal, and (ii) provides the speaker output signal to a speaker via the speaker output node; and (b) the noise suppressor generates the speaker output signal based on at least the first audio signal, for provision to the speaker via the speaker output node.

2. The invention of claim 1, wherein if the mobile communication device is in the non-call mode, then:

the noise characterizer provides to the noise suppressor a background noise signal based on the first audio signal; and the noise suppressor generates the speaker output signal based on at least the background noise signal, for provision to the speaker via the speaker output node.

3. The invention of claim 2, wherein the mobile communication device further comprises a local audio source adapted to provide a local audio signal in the non-call mode, and wherein the speaker output signal substantially corresponds to the background audio signal subtracted from the local audio signal.

4. The invention of claim 1, wherein if the mobile communication device is in the non-call mode, then:

the noise characterizer generates a noise-inverted audio signal based on the first audio signal; and the noise suppressor generates the speaker output signal based on at least the noise-inverted audio signal, for provision to the speaker via the speaker output node.

5. The invention of claim 4, wherein the mobile communication device further comprises a local audio source adapted to provide a local audio signal in the non-call mode, and wherein the speaker output signal substantially corresponds to the noise-inverted audio signal added to the local audio signal.

6. The invention of claim 1, wherein the mobile communication device further comprises a local audio source adapted to provide a local audio signal in the non-call mode, and wherein the speaker output signal substantially corresponds to the first audio signal subtracted from the local audio signal.

7. The invention of claim 1, wherein the mobile communication device further comprises a local audio source adapted to provide a local audio signal in the non-call mode, and wherein the speaker output signal is also based on the local audio signal.

8. The invention of claim 7, wherein the local audio source is internal to the mobile communication device.

9. The invention of claim 7, wherein the local audio source is external and connected to the mobile communication device via a connection jack.

10. The invention of claim 1, wherein a portion of the path from the speaker to the speaker output node is wireless.

11. The invention of claim 1, wherein a portion of the path from the microphone to the microphone input node is wireless.

12. The invention of claim 1, wherein the noise characterizer derives the background noise signal from the first audio signal by one of (a) sampling the sounds picked up by the microphone during periods the user is not talking and (b) derivation based on characteristics of at least one of (i) human voice and (ii) background noise.

13. The invention of claim 1, wherein the noise characterizer derives the background noise signal from the first audio signal by using a second microphone sufficiently isolated from the user's voice to provide a background noise signal.

14. A wireless transceiver having operation in at least two modes, the transceiver comprising:

a processor coupled to a microphone and a speaker, the microphone providing a first audio signal; and an analog front-end (AFE) coupled to an antenna, the AFE configured to (i) provide the antenna with a first radio signal based on a second audio signal and (ii) generate a third audio signal based on a second radio signal from the antenna, wherein:

the DSP comprises a noise characterizer, a noise suppressor, and a received-audio processor;

in a first mode:

the noise characterizer (i) derives a background noise signal from the first audio signal, wherein the background noise signal characterizes the background noise near the microphone, (ii) the noise suppressor generates the second audio signal as a combination of the first audio signal and the background noise signal, and (iii) the received-audio processor generates a speaker signal for the speaker based on the third audio signal, and the AFE generates the first radio signal based on the second audio signal; and in a second mode:

the noise suppressor of the processor generates a speaker signal based on at least the first audio signal, for provision to the speaker via a speaker output node.

15. A mobile communication device comprising a digital signal processor (DSP), a microphone input node, a speaker output node, an analog front-end, and an antenna, the mobile communication device adapted to operate in a call mode and a non-call mode, wherein:

the microphone input node is adapted to receive a first audio signal corresponding to sound captured by a microphone connected to the microphone input node and located near a user of the mobile communication device;

the DSP comprises a noise characterizer, a noise suppressor, and a received-audio processor;

if the mobile communication device is operating in the call mode, then:

(a) the DSP (i) derives a background noise signal from the first audio signal, wherein the background noise signal substantially characterizes background noise near the user, (ii) generates a second audio signal substantially equivalent to the sum of the first audio signal and an inverse of the background noise signal, and (iii) provides the second audio signal to the analog front-end;

(b) the analog front-end receives the second audio signal and generates a corresponding first radio-frequency signal for transmission by the antenna to a wireless network;

(c) the antenna receives from the wireless network a second radio-frequency signal for transmission to the analog front-end, which generates a corresponding received-audio signal;

(d) the DSP provides to a speaker via the speaker output node a speaker output signal based on the received-audio signal;

(e) the noise characterizer derives the background noise signal from the first audio signal;

(f) the noise suppressor generates the second audio signal using the background noise signal and the first audio signal; and (g) the received-audio processor processes the received-audio signal from the analog front-end and generates the speaker output signal based on the received-audio signal, for provision to the speaker via the speaker output node; and if the mobile communication device is operating in the non-call mode, then:

(a) the DSP (i) generates a speaker output signal based on at least the first audio signal, and (ii) provides the speaker output signal to a speaker via the speaker output node;

(b) the noise suppressor generates an output audio signal based on at least a first input signal; and (c) the received-audio processor generates the speaker output signal based on the output audio signal, for provision to the speaker via the speaker output node.

16. The invention of claim 15, wherein if the mobile communication device is in the non-call mode, then:

the noise characterizer provides to the noise suppressor a background noise signal based on the first audio signal; and the first input signal comprises the background noise signal.

17. The invention of claim 16, wherein the mobile communication device further comprises a local audio source adapted to provide a local audio signal in the non-call mode, and wherein the output audio signal substantially corresponds to the background noise signal subtracted from the local audio signal.

18. The invention of claim 15, wherein if the mobile communication device is in the non-call mode, then:

the noise characterizer generates a noise-inverted audio signal based on the first audio signal, for provision to the noise suppressor; and the first input signal comprises the noise-inverted audio signal.

19. The invention of claim 18, wherein the mobile communication device further comprises a local audio source adapted to provide a local audio signal in the non-call mode, and wherein the output audio signal substantially corresponds to the noise-inverted audio signal added to the local audio signal.

20. The invention of claim 15, wherein if the mobile communication device is in the non-call mode, then the first input signal comprises the first audio signal.

21. The invention of claim 20, wherein the mobile communication device further comprises a local audio source adapted to provide a local audio signal in the non-call mode, and wherein the output audio signal substantially corresponds to the first audio signal subtracted from the local audio signal.

22. The invention of claim 15, wherein a portion of the path from the speaker to the speaker output node is wireless.

* * * * *